US007556258B2

(12) United States Patent
Bergander et al.

(10) Patent No.: US 7,556,258 B2
(45) Date of Patent: Jul. 7, 2009

(54) FEED ROLLER, FEED ROLLER ASSEMBLY, AND SHEET HANDLING SYSTEM

(75) Inventors: Nikolaus Bernhard Bergander, Rottweil (DE); Andreas Wardak, Rottweil (DE); Peter Xaver Kearney, Buchheim (DE)

(73) Assignee: BDT AG, Rottweil (DE)

( * ) Notice: Subject to any disclaimer, the term of this patent is extended or adjusted under 35 U.S.C. 154(b) by 223 days.

(21) Appl. No.: 11/704,510

(22) Filed: Feb. 9, 2007

(65) Prior Publication Data

US 2008/0012203 A1 Jan. 17, 2008

Related U.S. Application Data

(60) Provisional application No. 60/772,082, filed on Feb. 10, 2006.

(30) Foreign Application Priority Data

Feb. 10, 2006 (DE) ..... 20 2006 002 248 U

(51) Int. Cl.
*B65H 3/06* (2006.01)

(52) U.S. Cl. ..... 271/120; 271/119

(58) Field of Classification Search ..... 271/119, 271/109, 120, 121
See application file for complete search history.

(56) References Cited

U.S. PATENT DOCUMENTS

| | | | | |
|---|---|---|---|---|
| 4,437,656 | A * | 3/1984 | Onoda et al. | 271/10.12 |
| 5,372,359 | A | 12/1994 | Miura et al. | |
| 5,934,664 | A | 8/1999 | Murayama et al. | |
| 6,270,071 | B1 * | 8/2001 | Asada | 271/119 |
| 6,331,002 | B1 * | 12/2001 | Yoshino et al. | 271/117 |
| 6,341,774 | B1 | 1/2002 | Ueda | |
| 6,547,237 | B2 | 4/2003 | Sugino et al. | |
| 2004/0251593 | A1 * | 12/2004 | Liu et al. | 271/109 |

FOREIGN PATENT DOCUMENTS

| | | | |
|---|---|---|---|
| FR | 2672275 | A1 * | 8/1992 |
| JP | 1-321225 | A | 12/1989 |
| JP | 2-132025 | A | 5/1990 |
| JP | 3-162331 | A | 7/1991 |

* cited by examiner

*Primary Examiner*—Patrick H Mackey
*Assistant Examiner*—Ernesto Suarez
(74) *Attorney, Agent, or Firm*—Bachman & LaPointe, P.C.

(57) ABSTRACT

A feed roller is provided for use in a feed roller assembly for intermittently feeding sheets. The feed roller has a body having a cross-section including an arc portion forming a partially cylindrical configuration. A support member is coupled to the body on at least one side of the body. A distance roller is rotatably supported by the support member relative to the body. The distance roller is spaced apart opposite the arc section parallel to the body.

20 Claims, 7 Drawing Sheets

FEED ROLLER, FEED ROLLER ASSEMBLY, AND SHEET HANDLING SYSTEM

CROSS-REFERENCE TO RELATED APPLICATIONS

Benefit is claimed of U.S. patent application Ser. No. 60/772,082, filed Feb. 10, 2006, and priority is claimed of German patent application 20 2006 002 248, the disclosures of which are incorporated by reference herein as if set forth at length.

BACKGROUND OF THE INVENTION

The invention relates to a feed roller, a feed roller assembly for intermittently feeding sheets, and a sheet handling system.

A feed roller and a feed roller assembly of the mentioned kind are well known in the art. As listed below some of these provide a preceding glide shoe or a side-mounted distance roller for the feed roller. The prior art feed rollers, however still have significant drawbacks.

In U.S. Pat. No. 5,372,359 a gliding shoe is pressed onto the pad. There is a comparatively high coefficient of friction to the pad. This results in: a higher force to drive; a speed limitation with regard to the throughput; and possibly a squeaking noise during separation.

Prior art rollers with side-mounted distance roller are known as a feed roller having a side-mounted distance roller or a feed roller with a distance roller mounted on each side or a feed roller the axle of which has a distance roller for the chord portion on each side of the feed roller. Side-mounted rollers or members are disclosed in JP3162331 A, JP2132025 A, JP1321225 A, and U.S. Pat. No. 4,437,656.

Disadvantages of side-mounted preceding distance rollers or cam shaped members which are side mounted are as follows. The preceding distance roller fixed and restricted to one or both sides of the feed roller is, in principle, intended to hold a retard pad in an appropriate circular distance to the feed roller's arc portion by the time the nose piece of the feed roller is pulling one or several sheets from the lift plate onto the retard pad. But the side-mounted members or rollers will cause the sheets to rise at their center, which is disadvantageous and may, in the worst case, even cause a paper jam. Consequently the problem arises to improve sheet feeding, in particular reliability thereof, whereas still a friction for feeding a sheet should be as low as possible.

This is where the invention comes in, the object of which is to specify a feed roller, a feed roller assembly, and a sheet handling system which have improved reliability of sheet feeding and lower friction for sheet feeding operation.

SUMMARY OF THE INVENTION

The object is achieved by the feed roller, the feed roller assembly, and the sheet handling system mentioned in the introduction, wherein in accordance with the invention it is proposed that the feed roller comprises: a body having a cross section comprising an arc portion and a chord portion to substantially form a semicylindrical configuration; a support member connected to at least one side of the body; and a distance roller provided freely rotatable at said support member. The distance roller is spaced apart in a distance opposite said chord portion and extends along an axis of said body.

The concept of the instant invention applies a distance roller basically extending along the total axis the feed roller. The rotatable body of the distance roller has no contact to the chord portion of the feed roller. The rotatable body guarantees that the contact to the papers is restricted to a single line basically extending along the axis of the feed roller. There is a contact gap between said contact line of the body of the distance roller and a leading portion, i.e. nose part of the frictive part of the feed roller. These and other measures make sheet feeding more reliable and less frictive. In particular the prior art problems as mentioned in the introduction are avoided.

According to the concept of the invention, a sudden impact on the retard pad by the feed roller's nose piece during the transition of the chord portion to the arc portion of the feed roller at a feed start is avoided. The preceding distance roller extending along the total axis of the feed roller is depressing the retard pad to a radius equal or similar to the radius of the nose part of the feed roller when it gets in contact with the paper. This is done without the risk of rising of the paper of affecting the paper disadvantageously in other ways. Moreover, as a distance member is formed as the distance roller feeding is performed basically without any friction. The pre-adjustment of the pad by means of the distance roller of the invention does enable a smooth transition of the uppermost paper onto the pad.

On the contrary when the transition of the retard pad's circular path is not adjusted to the nose piece of the feed roller double or even multipicks are to be expected as the retard pad all of a sudden is pushed down by the nose piece of the feed roller which is causing a small but unavoidable overshoot of the pad towards a higher circular path. This will open the gap between roller and the pad in a way which invite multiple sheets to be inserted into the gap.

With the proceeding roller this impact may be there as well, however, in general the pad will be in a stable position by the time the friction part of the roller is moving a paper on it.

Further objects and advantages of the invention will become apparent from the specification and accompanying claims and from the accompanying drawing.

For a more complete understanding of this invention, the invention will now be described in detail with reference to the accompanying drawing. The detailed description will illustrate and describe, what is considered as a preferred embodiment of the invention. It should of course be understood, that various modifications and changes in form or detail could readily be made without departing from the spirit of the invention. It is therefore intended that the invention may not be limited to the exact form and detail shown and described herein, not to anything less than the whole of the invention disclosed herein and as claimed herein after. Further the features described in the description, the drawing and the claims disclosing the invention, may be essential for the invention considered alone or in combination. Whereas the invention has particular utility for, and will described as associated with, a sheet feeding device for handling papers to be used in a copier, it should be understood that the system and its method of operation are also operable in association with other forms of sheet handling systems. For example, the system is also applicable for printers, scanners and paper separators and the like.

BRIEF DESCRIPTION OF THE DRAWINGS

For a more complete understanding of the invention reference should be made to the accompanying drawing, wherein.

Like reference numbers and designations in the various drawings indicate like elements.

DETAILED DESCRIPTION

Figures 1, 2:
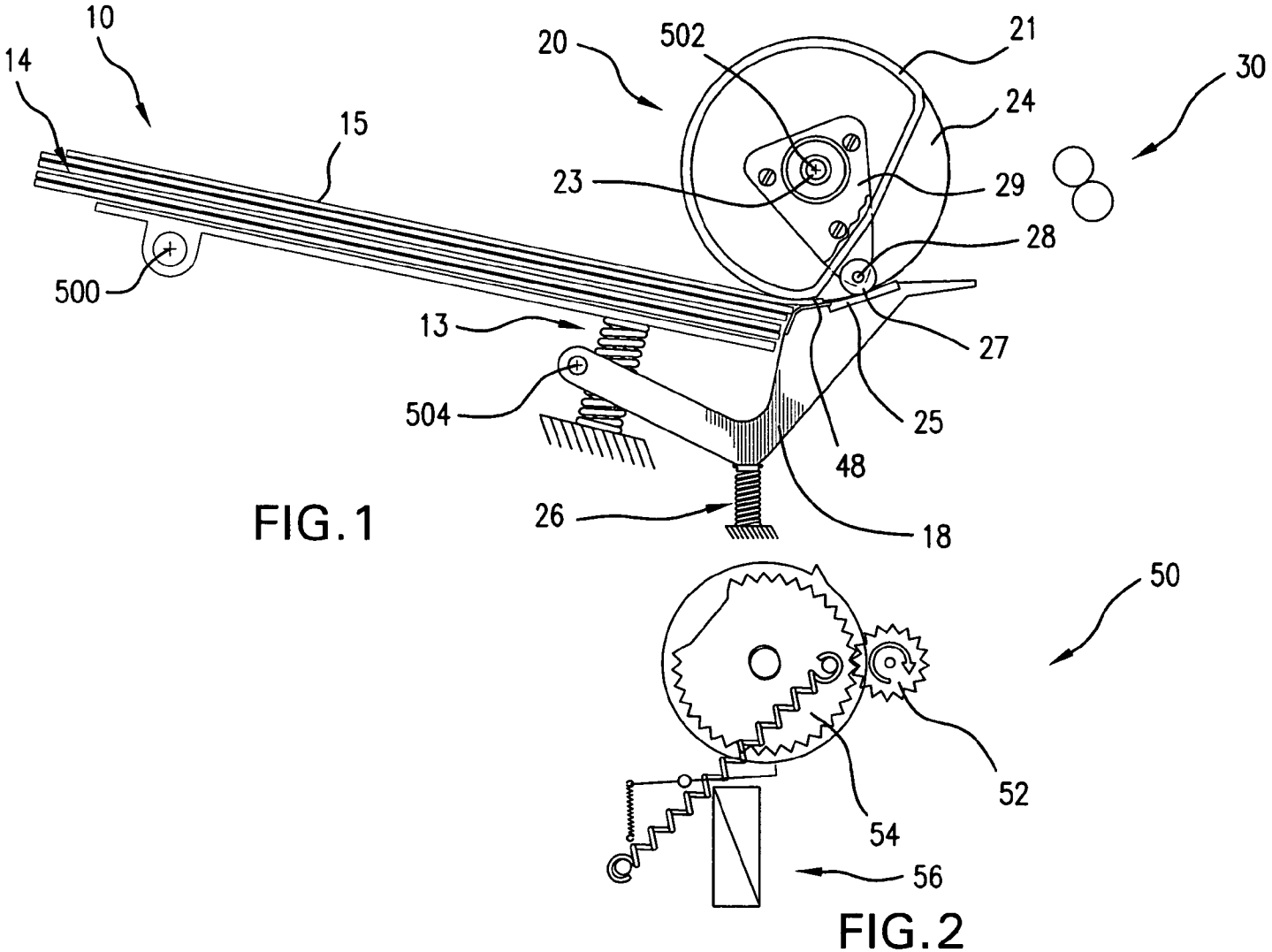
FIG. 1 is a cutaway side view of a feed roller assembly according to a preferred embodiment of the invention.
FIG. 2 is a cutaway side view of a drive mechanism for the feed roller assembly of FIG. 1.

The following specification discloses improvements on a sheet feeding device as shown in FIG. 1 which is separating papers and substrates and the like for further use in paper handling devices such as copiers, printers, scanners and the like. The device includes a paper tray assembly 10 and a feed roller assembly 20. The drawings are not to scale and various dimensions and spacings are exaggerated for ease of reference. The degree may vary figure-to-figure.

A sheet in form of a paper is usually deposited as a stack 14 on a loadable paper tray 11 or plate or the like which is biased to the feed roller assembly 20 by means of a spring 13. The spring bias elevates a downstream end of the tray by pivoting the tray about an upstream pivot axis 500.

The feed roller assembly 20 comprises a feed roller 21, fixed to a rotatable drive shaft 23 for rotation about an axis 502. The assembly 20 further comprises a pair of cylindrical free running rollers 24, also referred to as idler rollers, coupled to the drive shaft 23 and disposed on opposite sides of the feed roller 21. A pad 25, also referred to as a retard pad, is mounted on a lever 18 springloaded by a spring 26 to be pressed against the feed roller 21 or the idler rollers 24 respectively. The exemplary retard pad 25 is mounted to a distal end of the lever, whereas a proximal end is pivotally mounted for rotation about a pivot axis 504.

Figure 3:
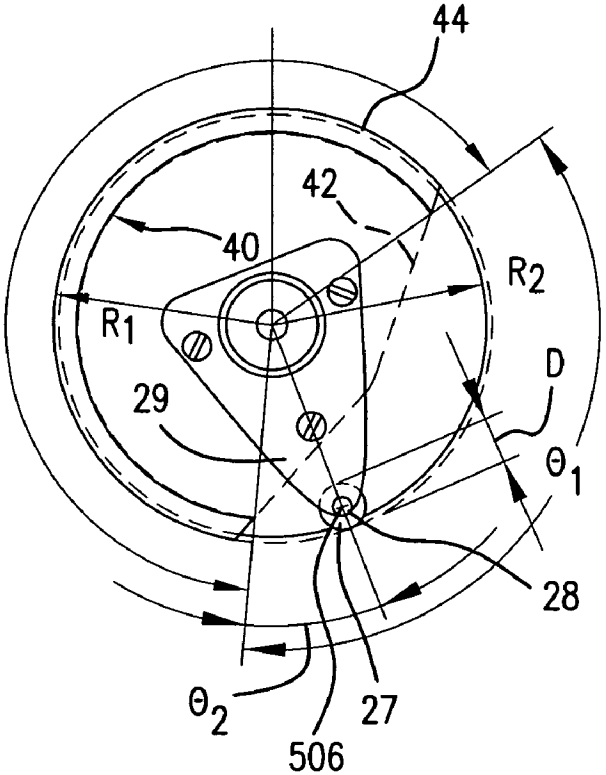
FIG. 3 is a detailed cutaway side view of the feed roller of the assembly of FIG. 1.

As shown in FIG. 3 the feed roller 21 has a cross-section comprising an arc portion 40 and a chord portion 42. Mantel 44 along at least the arc portion of the feed roller is of a resilient high friction material (e.g., a rubber).

Figure 4:
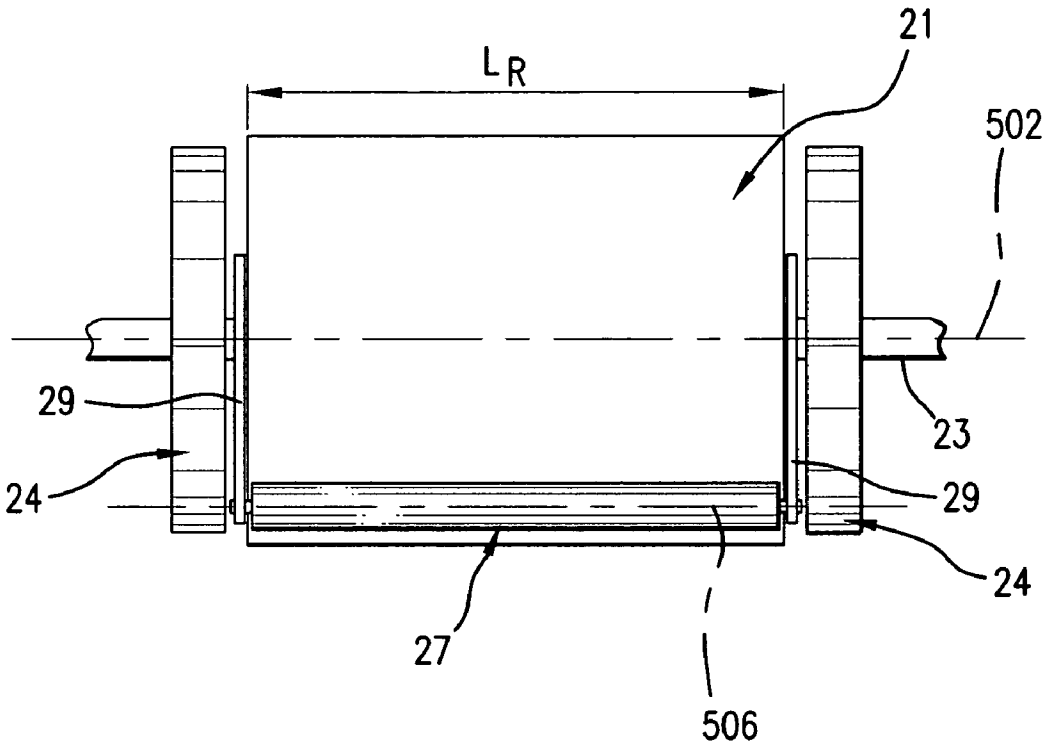
FIG. 4 is a front view of the feed roller of the assembly of FIG. 1.

As shown in FIG. 4 the distance roller 27 is spaced apart from the feed roller direction beyond said chord portion 42 and continuously extends along a transverse span of the body of feed roller 21. The distance roller has a periphery lying within the outer radius $R_1$ of the arc portion 40 of the feed roller 21. The distance roller 27 is freely running for rotation about an axis 506. The exemplary distance roller is mounted on an axle 28, kept by axle supports 29 which are fixed to the core of the feed roller 21. The length of the distance roller 27 essentially corresponds to the length of the feed roller 21 (e.g., the distance roller extends along the axle 28 along its total length). This avoids rising of a center of a paper during feeding operation.

As shown in FIG. 4 the length $L_R$ of the feed roller 21 is about 30 mm. Respectively the distance roller is of similar length. Of course the length of the distance roller 27 and the feed roller 21 may vary, in particular in a typical range between 25 mm and 35 mm.

As shown in FIG. 3 the radius $R_1$ of the feed roller is about 19 mm. Other preferred embodiments may also use a radius in a range between 15 mm and 25 mm. In this embodiment the arc portion 40 extends on the surface of the feed roller 21 along an angle section $\theta_0$ of an exemplary 225° leaving the portion 42 with an angle $\theta_1$ of 135°. Exemplary $\theta_0$ is 220° to 230°. Exemplary $\theta_1$ is 130° to 140°.

The distance roller 27 has an exemplary diameter D of 10 mm. Other embodiments may have a diameter in a range of 8-12 mm or preferable in a range of 4-10 mm.

The distance roller 27 is arranged at a position opposite to said chord portion C near a leading edge (nose point) 48 of the arc portion 40. An exemplary angle $\theta_2$ between the distance roller 27 and the leading edge 48 is 25° in the embodiment of FIG. 3. Other embodiments may preferably use also an angle in a range between about 20° to 30°. Consequently the feed roller 21 is arranged to come into contact with a sheet of paper 15 along a contact line, said contact line being separated by a gap of no contact (i.e., essentially along the angle $\theta_2$ to a second contact line basically in the area of the leading edge 48 of said arc portion 40. Said contact line (or outer rim) of the feed roller 21 is located at a radius $R_1$ and an outer rim of said free running roller 24 is located at a radius $R_2$, wherein $R_2$ is smaller than $R_1$. However, the difference is only slight. In particular a preferred extremity of the distance roller may be characterized by the relation of $R_2$ and $R_1$. In the instant embodiment $R_2$ amounts to about 99% of $R_1$. Other preferred ranges of $R_2$ are 95-100% of $R_1$, 98-100% of $R_1$ and 98.5-99.5% of $R_1$.

As shown in FIG. 1 the distance roller 27 is arranged to come into contact with the paper at feed start prior the feed roller's nose point 48 coming into contact with the paper. Running freely at least its surface material has a low coefficient of friction so to generally keep friction between the paper and the distance roller 27 low.

The predominant effect and functionality is described with reference to FIGS. 5-8.

Figure 6:
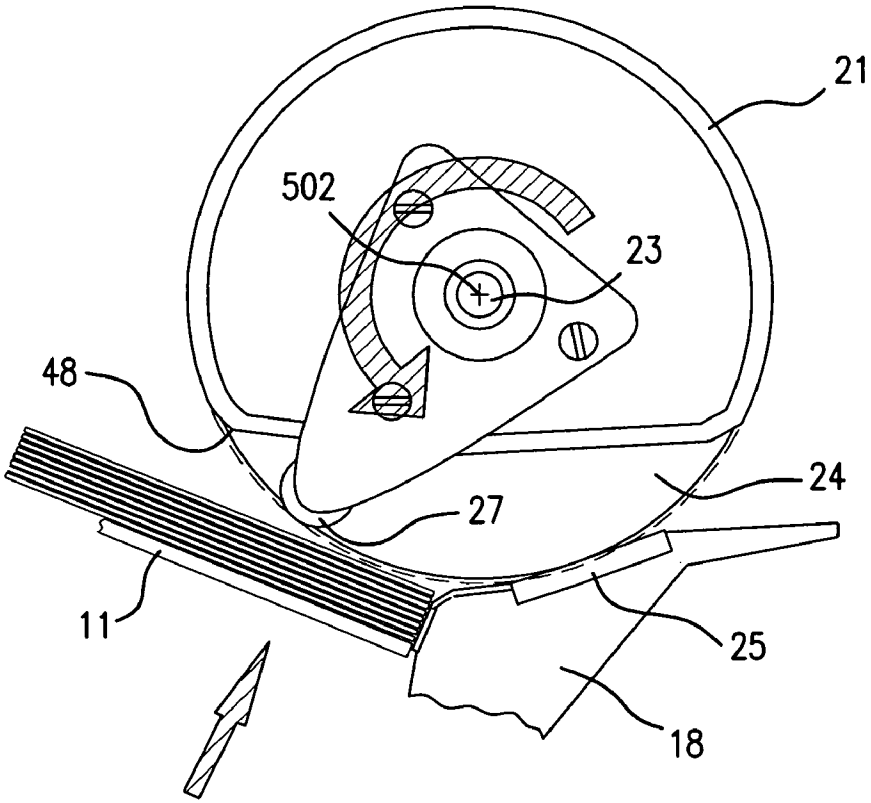
FIG. 5, FIG. 6, FIG. 7, and FIG. 8 illustrate a sequence of feed roller movement each in a detailed cutaway side view.
Figure 5:
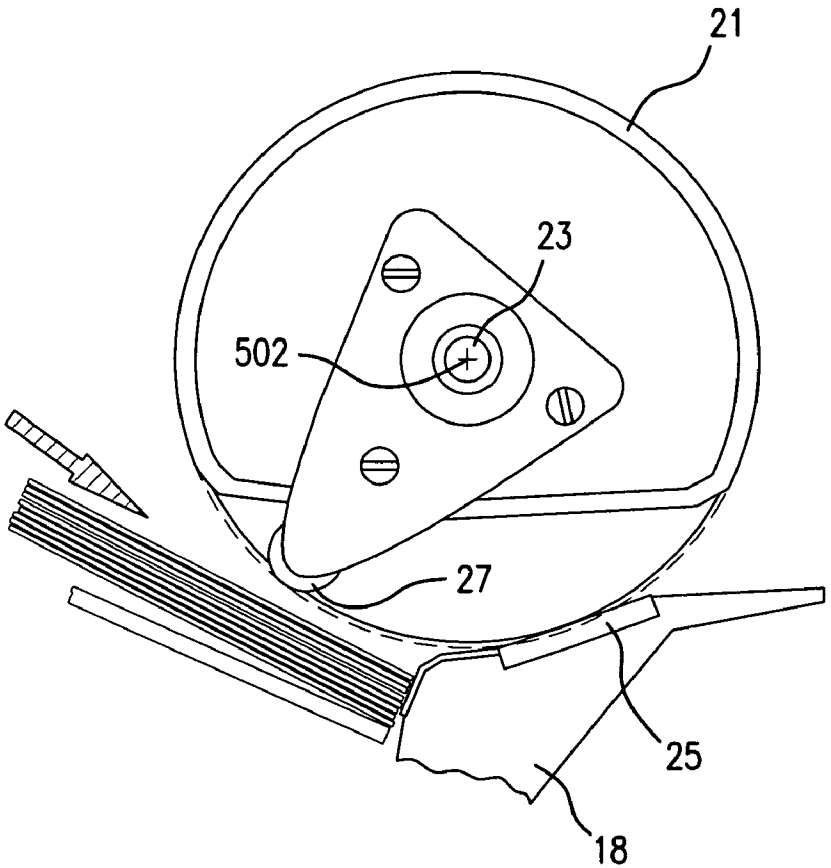

During a feed cycle operation when the roller assembly 20 is turned continuously by means of a drive mechanism 50 (FIG. 2) The drive mechanism 50 includes a motor-driven drive gear 52 engaged to a timing gear 54. The mechanism 50 further includes a solenoid 56 activated by a feed start signal. The spring 13 lifts the tray leading edge so that the uppermost sheet 15 is in a position to engage the roller assembly 20 (FIG. 6). As the roller assembly 20 rotates between the FIG. 6 and FIG. 7 orientations, the distance roller 27 is moved over the leading edge of the uppermost sheet 15, slightly pressing the stack 14 down against the load spring 13.

Figure 8:
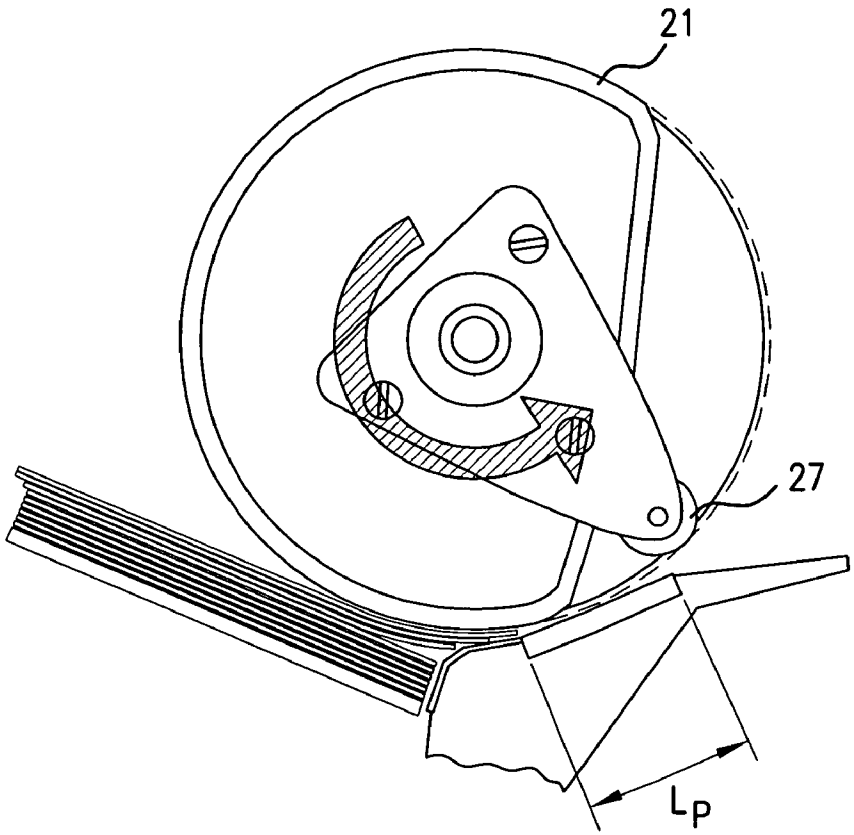
Figure 7:
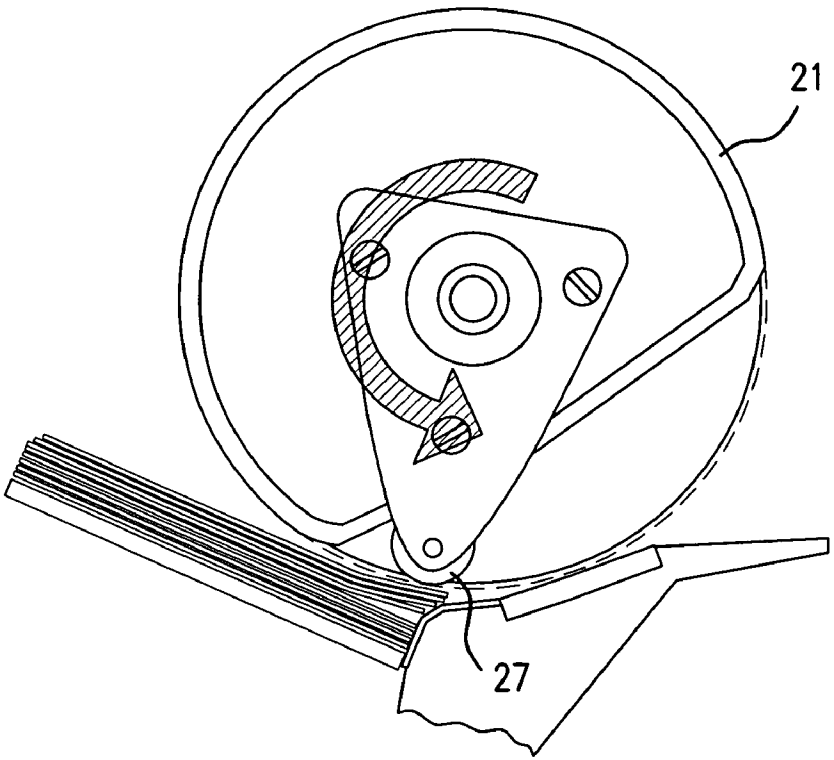

After being rolled over the leading edge of the uppermost sheet 15—without or only slightly moving the sheet towards the output direction, the distance roller 27 comes into contact with the surface of the retard pad 25 (during transition between FIGS. 7 and 8).

By this time the pad 25 slightly is being pressed down from the radius $R_2$ of the idler roller 24, to the feed roller outer radius $R_1$.

While the distance roller 27 still is traveling on the pad 25 the feed roller's nose point 48 is pulling the uppermost paper (or even some of the subsequent ones) from the paper stack onto the pad by means of its frictional connection.

With the retard pad 25 in a prepared height position as defined by the circular distance to the feed roller, the sheet(s) of paper smoothly get driven onto the pad 25 by the feed roller 21 (FIG. 8).

As the surface of the retard pad 25 slightly is inclined with respect to the paper feed direction, the sheets 15 consequently get shingled out along the pads 25 surface. In this embodiment the pad has a length $L_P$ of 20 mm. Other embodiments may use a preferred length of between about 18-22 mm.

By means of graduated frictional factors between feed roll 21, retard pad 25 and the subsequent sheets 14 to come on the one hand and with the shingling effect of the retard pad 25 on the other hand only the uppermost paper 15 will make it to the exit rollers 30 (FIG. 1), being dragged by the feed roller 21 against the resistance of the other sheets in the stack 14 or/and the retard pad 25.

Figure 9:
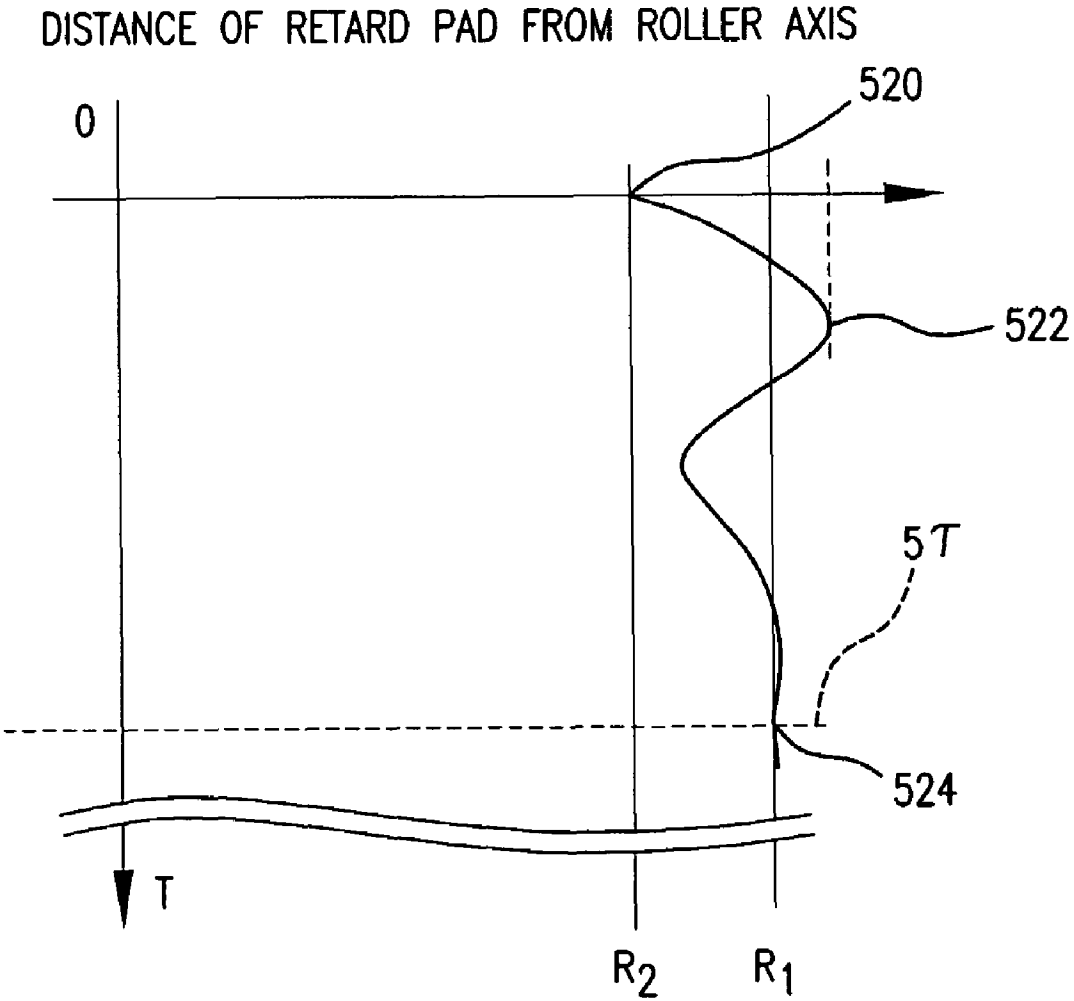
FIG. 9 is a graph showing the position of a pad as a function of time after contact with a distance roller according to the concept of the invention.

FIG. 9 shows the position of the retard pad 25 over time.

Before the distance roller 27 is reaching the retard pad 25 (position 520), the pad 25 is biased against the idler rollers' 24 perimeter at $R_2$ which is slightly smaller than the perimeter at $R_1$ of the feed roller 21.

Without the distance roller 27 the nose piece of the feed roller 21 firstly would have to push down the retard pad 25 at the entrance corner. As a consequence this would disadvantageously open the gap between the feed roller 21 and the pad 25 in a way that would occasionally allow too many sheets to enter the gap. As a result double or greater multipicks could be expected, as the retard pad 25 all of a sudden would be pushed down by the nose piece 48 of the feed roller 21. This would cause an unavoidable overshoot of the retard pad with its lever mechanics towards a higher circular path with regard to the drive shaft axis 502.

With the preceding distance roller 27 according to the concept of the invention the impact described above on the retard pad 25 may be there as well, however it will be much smaller (position 522). Also the pad 25 will be in a steady-state position (position 524) by the time the friction part 44 of the roller 21 is moving a paper 15 onto it. Between positions 522 and 524, FIG. 9 shows a partial recovery of the pad position to a level between $R_1$ and $R_2$.

Further advantages of the inventive concept are described as follows and may depend on the detailed configuration of the distance roller 27. A first configuration provides a distance roller 27 preferably having a low coefficient of friction, so to essentially avoid any friction between the paper and the distance roller 27. For this purpose, a single distance roller 27 is provided and at least the surface of the distance roller 27 is preferably made of a comparatively hard material preferably of a low coefficient of friction. The hard material may be chosen from the group consisting of steel, hard plastic material (e.g., polyamide (PA) or polyoxymethylene polyacetyl (POM)), and the like. Hard material preferably avoids a non-circular deformation of the distance roller 27 against the paper.

Figure 10:
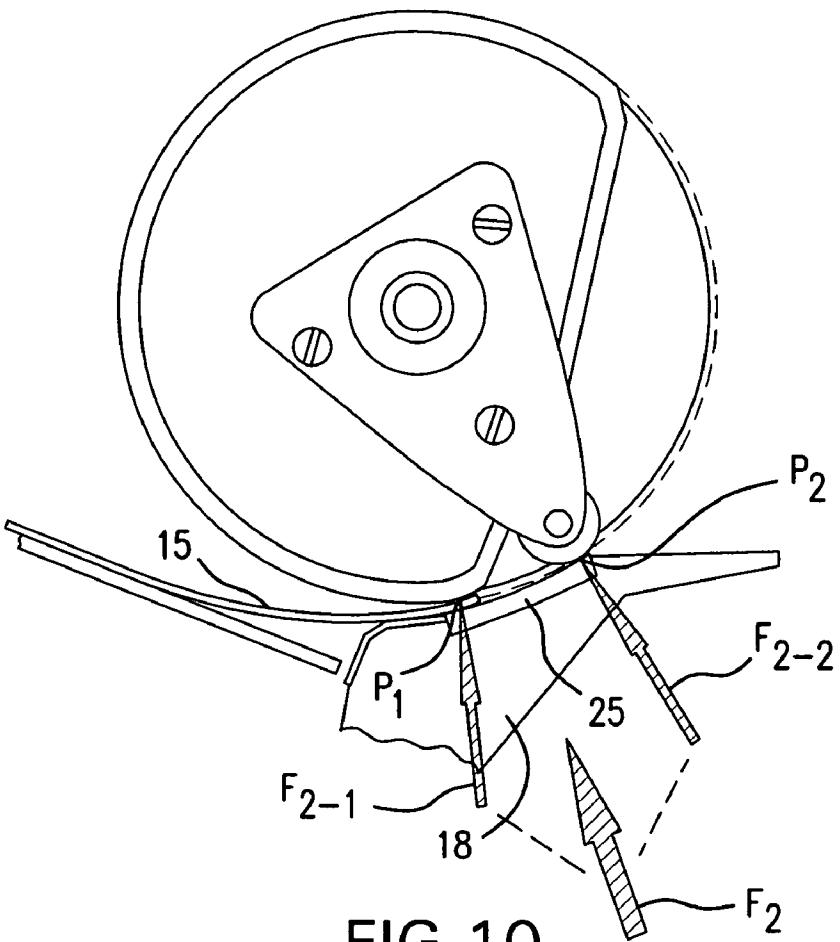
FIG. 10 is an enlarged cutaway side view of the feed roller, distance roller and pad, wherein the distance roller is still in touch with the pad.

As a result after being rolled over the loading edge of the uppermost sheet 15—basically without significantly moving the sheet 15 towards the output direction—the distance roller 27 is getting in contact with the retard pad's 25 surface. The functionality of this first configuration is described with reference to FIG. 10 and FIG. 11, which illustrate a sequence of operation of the feed roller 21, the distance roller 27 and the retard pad 25. FIG. 10 shows a situation of operation wherein the uppermost sheet 15 just is inserted onto the retard pad 25 by the feed roller 21. The distance roller 27 is still in touch with the retard pad 25, having opened the gap for the uppermost sheet 15 and possibly even several sheets. The spring force $F_2$ of the retard pad 25 may be subdivided between forces acting on a paper contact point $P_1$ (force $F_{2\text{-}1}$) and a distance roller contact point $P_2$ (force $F_{2\text{-}2}$). A particular preferred development of the inventive concept provides a pad shape of the retard pad 25 designed such that the impact of the distance roller 27 on the retard pad 25 is preferably lowered. In particular, by providing the pad 25 with a sloping surface the preferred development may provide that the impact of the distance roller 27 on the pad 25 is restricted to a smooth gliding onto the pad with the paper in between. Thereby, the impact as illustrated in FIG. 9 is preferably lowered or even removed. In any case the operating position of the pad 25 will reach its working position (524) earlier than in prior art embodiments. In other words the pad time constant ($5\tau$) is preferably reduced by the concept of the instant development.

Figure 11:
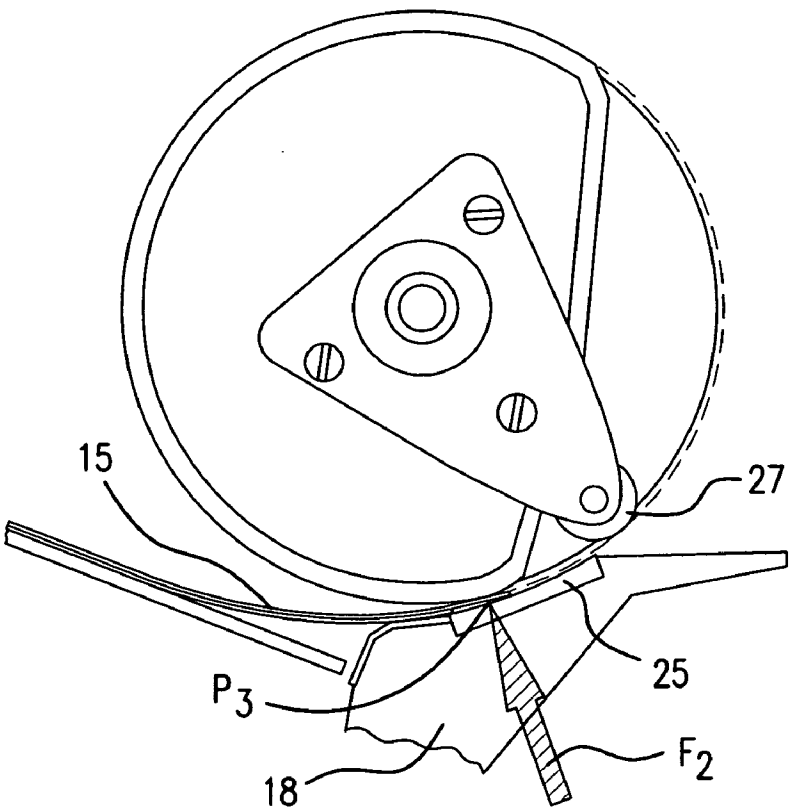
FIG. 11 is an enlarged side view of the feed roller, distance roller and pad, wherein the distance roller has just left the pad.

FIG. 11 shows an operation situation wherein the distance roller 27 has just left the retard pad 25. The retard pad spring pressure $F_2$ is now fully acting on point $P_3$. This favors an effective shingling of sheets being inserted in the gap between the feed roller 21 and the retard pad 25. In other words the above-mentioned gap of no contact (for instance angle range of FIG. 3 providing angles $\theta_2$ between about 20°-30°) preferably allows that the retard pad spring pressure $F_2$ is fully acting on an inserted paper as soon as possible. As a consequence just a single sheet is going to be fed to the exit roller assembly 20 and double or even multipicks are securely avoided. Thereby the concept of the instant invention is also superior to prior art concept using glide shoes or other kind of guide members as outlined in the introduction.

Figure 13:
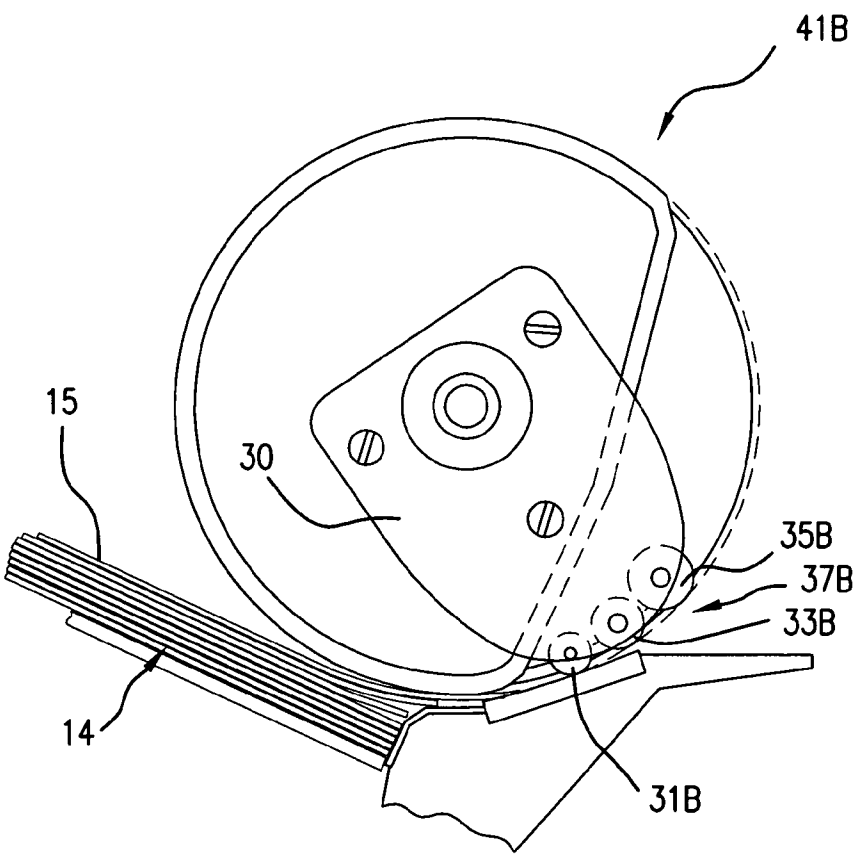
FIG. 12 and FIG. 13 are cutaway side views of two further embodiments of a feed roller in form of a wave generator roller.
Figure 12:
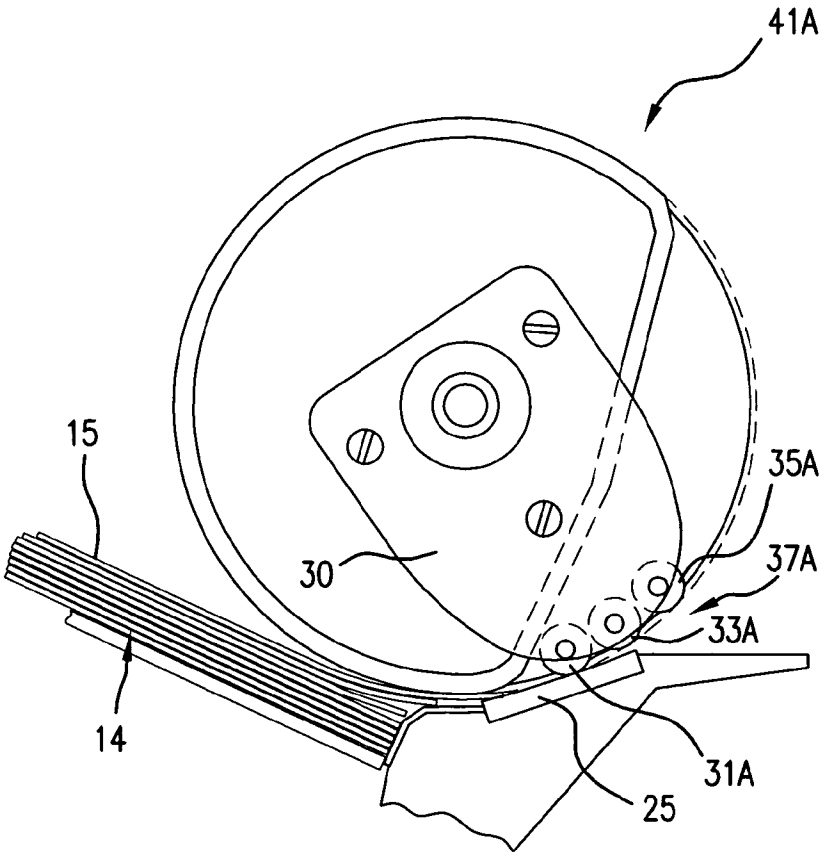

A second configuration provides a distance roller—also referred to as a wave generator roller—comprising two or more single rollers, which are arranged in a sequence on a support member 30. The embodiment of wave generator roller 37A shown in FIG. 12 comprises three rollers 31A, 33A, 35A of equal diameter. The embodiment of wave generator roller 37B of FIG. 13 comprises three rollers 31B, 33B, 35B the diameter of which is increasing along the sequence in the movement direction of the wave generator roller 37B. In principle, a wave generator roller 37A, 37B also achieves the above-mentioned advantages. Additionally the advantageous effects are achieved, which become clear from the following description with reference to FIG. 12 and FIG. 13. Preferably the rollers 31A, 31B, 33A, 33B, 35A, 35B of a wave generator roller 37A, 37B have an extremely low coefficient of friction. In particular at least the surface of the rollers 31A, 31B, 33A, 33B, 35A, 35B may be made for this purpose from a hard material, e.g. steel, hard plastic material (e.g., PA, POM), or the like.

In the case a first roller 35A, 35B is not able to shingle a sheet 15 from the stack 14,—which may be due to a fast processing speed of the feed roller 41A, 41B—this will be accomplished and/or at least continued by a second roller 33A, 33B and/or a third roller 31A, 31B. In other words the wave generator roller 37A, 37B achieves a repeatedly processed preceding separation technique by means of the multiple—at least two—rollers.

While being rolled over the uppermost paper 15 the wave generator's roller 37A, 37B slightly is shingling nearly out all sheets below. Due to the hard material and the comparatively soft paper stack, a propelling effect is achieved on nearly all the papers, at least those in an upper position in the stack by means of a hard roller being pressed and rolled on them and the uppermost sheet 15 is shingled out most when treated accordingly—however, in this case only in the range of about 0.1-0.2 mm with respect to the next sheet in the stack.

Although the effective distance the roller 37A, 37B in this case is being moved over the paper is limited to about 10-15 mm due to the arc it describes, which corresponds to a relative difference of about 0.1-0.2 mm of the uppermost sheet 15 to the subsequent one, the propelling or shingling effect is such that the static coefficient of friction between the papers can be overcome—even in the case of heavy paper stock. Due to the hard roller's pressing multiple papers below the uppermost paper 15 are shingled up.

Moreover any "edge welding" of the sheets is overcome also by the slight displacement of the sheets. "Edge welding" involves poor cutting conditions of the individual sheets in a ream of paper which have a tangible burr in the cut direction when performed with a edgeless tool. In case the sheets of a ream accidentally are inserted into the tray such that the burr is directed upwardly and with in the leading edge in feed direction, multipicks result because the uppermost sheet is connected (welded) to the subsequent one. In this case only a preceding separation technique will help, which is able to separate two subsequent sheets just a short distance but with high shingling force. This is effectively performed by means of the wave generator. After having rolled over the leading edge of the uppermost sheet 15, the wave generator roller 27 is getting in contact with the retard pad's surface. By this time the retard pad slightly is being pressed down from a radius of the idler roller to the roller outer radius $R_1$.

What has been described above are preferred embodiments of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A feed roller (21, 41A, 41B) for use in a feed roller assembly (20) for intermittently feeding sheets (15), comprising:

a body having a cross-section comprising an arc portion (40) and a chord portion (42) to substantially form a semicylindrical configuration;

a support member (29) connected to the body on at least one side of the body; and a distance roller (27, 37A, 37B) provided freely rotatable at said support member, wherein:

the distance roller (27, 37A, 37B) is spaced apart in a distance opposite to said chord portion to rotate with the body about an axis of the body and extends along a longitudinal span overlapping and essentially the same as a longitudinal span of the body.

2. The feed roller of claim 1 wherein:

the support member (29) is an axle support, wherein said distance roller (27) is provided on an axle (28) of the axle support.

3. The feed roller of claim 1 wherein:

said distance roller (27, 37A, 37B) is arranged at a position opposite to said chord portion (42) near a leading edge (48) of the arc portion (44).

4. The feed roller of claim 1 wherein:

said distance roller (27) comprises a single roller.

5. The feed roller of claim 1 wherein:

said distance roller (37A, 37B) comprises two, three or more rollers.

6. A feed roller assembly (20) for intermittently feeding sheets, comprising:

a rotatable drive shaft (23);

the feed roller (21, 41A, 41B) of claim 1 coupled to said drive shaft (23);

a cylindrical free running roller (24) disposed at at least one side of said feed roller (21);

a pad (25) biased against said feed roller (21) and/or said free running roller (24).

7. The feed roller assembly of claim 6 wherein:

the feed roller (21, 41A, 41B) is arranged to come into contact with a sheet of paper (15) along at least one contact line, said at least one contact line being separated by a gap of no contact to a second contact line basically in the area of a leading edge (48) of said arc portion (40).

8. The feed roller assembly of claim 7 wherein:

said at least one contact line (or outer rim) of the feed roller is located on a first circumference and an outer rim of said free running roller is located on a second circumference wherein said second circumference has a radius ($R_2$) smaller than a radius ($R_1$) of said first circumference.

9. The feed roller assembly of claim 8 wherein:

said at least one contact line is located on said first circumference said first circumference being basically the same as the circumference of said arc portion (40).

10. The feed roller assembly of claim 7 wherein:

a single contact line is provided.

11. The feed roller assembly of claim 7 wherein:

two, three or more contact lines are provided.

12. A sheet handling system comprising:

a feed roller assembly (20) of claim 7 for intermittently feeding sheets to the handling system.

13. A sheet handling system comprising:

a feed roller assembly (20) of claim 6 for intermittently feeding sheets to the handling system.

14. A sheet feeding system comprising:

a feed roller assembly held for rotation about a first axis and comprising:

a feed roller having a circular cylindrical surface of a first radius along a first sector;

a distance roller having a second axis; and a support member supporting the distance roller relative to the feed roller for rotation about the second axis, the second axis parallel to and spaced apart from the first axis outside of the sector so as to rotate with the feed roller about the first axis and the distance roller having a longitudinal span overlapping and essentially the same as a longitudinal span of the feed roller.

15. The system of claim 14 further comprising:

first and second idler rollers at opposite first and second ends of the feed roller and coaxial with the first axis, wherein:

the idler rollers have a second radius less than the first radius; and the distance roller and feed roller longitudinally overlap along majorities of their respective lengths.

16. The system of claim 15 wherein:

the circular cylindrical surface extends at least 180° about said first axis;

the distance roller protrudes radially beyond the second radius.

17. The system of claim 15 wherein:

said second radius is at least 98% of said first radius.

18. A method for feeding paper from a stack, comprising:

rotating a feed roller about a first axis;

in an initial stage, positioning a lever-mounted pad relative to the first axis via an idler roller;

depressing the pad via a central distance roller, the distance roller supported for rotation about a second axis spaced apart from the first axis, the second axis rotating about said first axis with said feed roller; and guiding a top sheet of said paper with the feed roller to pass over the pad, there being a partial recovery of the pad between the depressing and an initial engagement to the pad of the feed roller and top sheet.

19. The method of claim 18 wherein:

the depressing comprises a sequential depressing with a series of said distance rollers.

20. The method of claim 18 wherein:

the depressing is at least to a position of the pad during a main operational portion of said engagement.

* * * * *